US010875734B2

(12) United States Patent
Ichikawa et al.

(10) Patent No.: US 10,875,734 B2
(45) Date of Patent: Dec. 29, 2020

(54) BAG MAKING AND PACKAGING MACHINE

(71) Applicant: ISHIDA CO., LTD., Kyoto (JP)

(72) Inventors: Makoto Ichikawa, Ritto (JP); Satoshi Hashimoto, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 261 days.

(21) Appl. No.: 15/555,977

(22) PCT Filed: Jan. 26, 2016

(86) PCT No.: PCT/JP2016/052193
§ 371 (c)(1),
(2) Date: Sep. 6, 2017

(87) PCT Pub. No.: WO2016/147700
PCT Pub. Date: Sep. 22, 2016

(65) Prior Publication Data

US 2018/0057294 A1 Mar. 1, 2018

(30) Foreign Application Priority Data

Mar. 19, 2015 (JP) ..... 2015-056139

(51) Int. Cl.
*B31B 70/00* (2017.01)
*B31B 70/10* (2017.01)
(Continued)

(52) U.S. Cl.
CPC ..... *B65H 21/02* (2013.01); *B31B 70/005* (2017.08); *B31B 70/10* (2017.08); *B65B 9/08* (2013.01);
(Continued)

(58) Field of Classification Search
None
See application file for complete search history.

(56) References Cited

U.S. PATENT DOCUMENTS 2,899,143 A * 8/1959 Crosfield et al. ..... B65H 21/02 242/420.3
4,137,528 A * 1/1979 Traise ..... B31B 70/00 340/675
(Continued)

FOREIGN PATENT DOCUMENTS

DE 2439318 A1 2/1976
DE 29611789 U1 9/1996
(Continued)

OTHER PUBLICATIONS

The Search Report from the corresponding European Patent Application No. 16764531.6 dated Mar. 8, 2018.
(Continued)

*Primary Examiner* — Hemant Desai
*Assistant Examiner* — Tanzim Imam
(74) *Attorney, Agent, or Firm* — Shinjyu Global IP

(57) ABSTRACT

Provided is a bag making and packaging machine having superior workability in film joining work. A bag making and packaging machine is a bag making and packaging machine that uses film having at least one character or a figure printed on its front side, and is equipped with a film roll support unit, a conveyance unit, a bag making unit, and a light emitting component. The film roll support unit supports a film roll in which the film is wound in a roll. The bag making unit processes the film to make bags. The conveyance unit is positioned between the film roll support unit and the bag making unit. The conveyance unit feeds the film to the bag making unit. The light emitting component illuminates, from the direction of the front side of the film, the film positioned between the film roll support unit and the conveyance unit.

4 Claims, 13 Drawing Sheets

(51) Int. Cl.

| | |
|---|---|
| ***B65B 41/12*** | (2006.01) |
| ***B65B 9/08*** | (2012.01) |
| ***B65H 19/00*** | (2006.01) |
| ***B65H 26/06*** | (2006.01) |
| ***B65H 21/02*** | (2006.01) |
| *B31B 155/00* | (2017.01) |

(52) U.S. Cl.

CPC ..... *B65B 41/12* (2013.01); *B65H 19/00* (2013.01); *B65H 26/063* (2013.01); *B65H 26/066* (2013.01); *B31B 2155/0014* (2017.08); *B65H 2551/20* (2013.01)

(56) References Cited

U.S. PATENT DOCUMENTS 4,494,948 A * 1/1985 Teyssier, Jr. ..... B65H 45/1015 226/196.1
6,770,018 B2 * 8/2004 Tomic ..... B31B 70/00 493/11
6,820,399 B2 * 11/2004 Send ..... B65B 41/18 493/10
7,135,083 B2 * 11/2006 Middelstadt ..... B26D 1/405 156/157
8,834,334 B2 * 9/2014 Palm ..... B65H 23/1882 493/8
8,998,787 B2 * 4/2015 Selle ..... B31B 70/00 493/8
2013/0202837 A1 8/2013 Ehara et al.
2016/0101585 A1 * 4/2016 Park ..... B31D 5/0047 493/10
2017/0297842 A1 * 10/2017 Yanagida ..... G07D 11/14

FOREIGN PATENT DOCUMENTS

JP S60-061234 U 4/1985
JP H02-079359 U 6/1990
JP H04-191237 A 7/1992
JP H04191237 A * 7/1992
JP 4320248 B2 8/2009
JP 2011-195152 A 10/2011
JP 2011-230782 11/2011

OTHER PUBLICATIONS

The Search Report from the corresponding International Patent Application No. PCT/JP2016/052193 dated Apr. 12, 2016.
The Preliminary Report on Patentability (with Written Opinion) from the corresponding International Patent Application No. PCT/JP2016/052193 dated Sep. 28, 2017.

* cited by examiner

BAG MAKING AND PACKAGING MACHINE

PRIORITY

This is a National Stage Application under 35 U.S.C. § 371 of International Application PCT/JP2016/052193, with an international filing date of Jan. 26, 2016, which claims priority to Japanese Patent Application No. 2015-056139 filed on Mar. 19, 2015. The entire disclosures of International Application PCT/JP2016/052193 and Japanese Patent Application No. 2015-056139 are hereby incorporated herein by reference.

TECHNICAL FIELD

Certain implementations of the present invention relate to a bag making and packaging machine.

BACKGROUND

Conventionally, bag making and packaging machines that make bags using film wound in a roll have been known. For example, a bag making and packaging machine may feed film from a film roll and seal the film using a bag making unit to thereby make bags.

In such a bag making and packaging machine, the film roll is replaced when the film roll has reached its terminal end as a result of the film being consumed. When replacing the film roll, it becomes necessary to carry out film joining work of joining the terminal end of the film roll before replacement and the starting end of the film roll for replacement. When replacing the film roll, the film of the film roll before replacement is secured by a film holding mechanism and sucked by a film sucking mechanism, and the terminal end of the film roll is drawn in to the film sucking mechanism by a film retention mechanism, whereby the workability of the film joining work is improved and film loss is reduced.

SUMMARY

Normally, characters or figures are printed on the front side of the film. For this reason, in the film joining work, it is necessary for the terminal end of the film roll before replacement and the starting end of the film roll for replacement to be properly joined at a position in which their mutual characters or figures match, so that misalignment does not arise in the characters or figures at the joined section. If the film joining work is not properly carried out, the bag making and the printing of information on the film are temporarily or continuously not properly carried out, and film and product loss occurs.

However, in a bag making and packaging machine such as the one described above, it is common for the film that is fed from the film roll to be fed to the downstream side in a state in which the front side of the film faces the inside of the bag making and packaging machine while the back side faces the outside in association with the process of the bag making unit. For this reason, in the film joining work, there are cases where films that are in a state in which their back sides face the outside must be joined together. In this case, it can become difficult to properly carry out the film joining work unless some kind of mark is included on the back sides of the films.

A bag making and packaging machine according to a first aspect of the invention is a bag making and packaging machine that uses film having at least one character or figure printed on its front side, and comprises a film roll support unit, a bag making unit, a conveyance unit, and a light emitting component. The film roll support unit supports a film roll in which the film is wound in a roll. The bag making unit processes the film to make bags. The conveyance unit is positioned between the film roll support unit and the bag making unit. The conveyance unit feeds the film to the bag making unit. The light emitting component illuminates, from the direction of the front side of the film, the film positioned between the film roll support unit and the conveyance unit.

In the bag making and packaging machine according to the first aspect of the invention, the light emitting component illuminates, from the direction of the front side of the film, the film positioned between the film roll support unit and the conveyance unit. Because of this, in the film joining work when replacing the film roll, it becomes possible to pass the light projected from the light emitting component through the film, and to carry out the work while checking, from the back side, the characters or figures printed on the front side. As a result, it becomes easy to properly carry out the film joining work even in a case where it is required to join films that are in a state in which their back sides face the outside. Thus, the workability of the film joining work is improved.

It will be noted that the film that is used includes, for example, film whose front side can normally be seen from the back side (translucent) and film (e.g., aluminum-deposited film) in which characters or figures printed on the front side are visible from the back side when strong light is projected onto the film.

A bag making and packaging machine according to a second aspect of the invention is the bag making and packaging machine according to the first aspect, further comprising a work table. The work table is positioned between the film roll support unit and the conveyance unit. The work table aids work of joining a terminal end of the film roll before replacement and a starting end of the film roll for replacement when replacing the film roll. The light emitting component illuminates the film positioned on the work table.

Because of this, on the work table where the film joining work is carried out, the light is passed through film and it becomes possible to check the characters or figures printed on the front side. As a result, it becomes easier to properly carry out the film joining work.

A bag making and packaging machine according to a third aspect of the invention is the bag making and packaging machine according to the second aspect, wherein the work table includes a flat portion. The flat portion faces the front side of the film fed from the film roll. A slit is formed in the flat portion. The slit extends in the width direction of the film. The light emitting component is disposed below the flat portion. The light emitting component projects light through the slit.

Because of this, it becomes possible to compactly dispose the light emitting component in a space below the work table. As a result, a decline in compactness and a decline in workability caused by disposing the light emitting component are restrained.

A bag making and packaging machine according to a fourth aspect of the invention is the bag making and packaging machine according to any of the first aspect to the third aspect, further comprising a terminal end detection component. The terminal end detection component detects that the film roll supported by the film roll support unit has reached its terminal end. The light emitting component blinks or lights up in response to detection, by the terminal end detection component, of that the film roll has reached its terminal end.

Because of this, the user can visually recognize that the film roll has reached its terminal end and can quickly grasp when the film roll needs to be replaced. As a result, it becomes possible to shorten the amount of time that the machine is stopped, and productivity is improved.

In the bag making and packaging machine according to certain implementations of the invention, in the film joining work when replacing the film roll, it becomes possible to pass the light projected from the light emitting component through the film, and to carry out the work while checking, from the back side, the characters or figures printed on the front side. As a result, it becomes easy to properly carry out the film joining work even in a case where it is required to join films that are in a state in which their back sides face the outside. Thus, the workability of the film joining work is improved.

DETAILED DESCRIPTION

A bag making and packaging machine 100 according to an embodiment of the invention will be described below with reference to the drawings. It will be noted that the following embodiment is a specific example of the invention, is not intended to limit the technical scope of the invention, and can be appropriately changed in a range that does not depart from the spirit of the invention. Furthermore, expressions indicating directions, such as upper, lower, left, right, front face (front), and back face (rear), will be used in the following description, and unless otherwise specified these directions will mean the directions shown in FIG. 4 to FIG. 8 and FIG. 10 to FIG. 13.

(1) General Configuration of Bag Making and Packaging Machine 100

Figure 1:
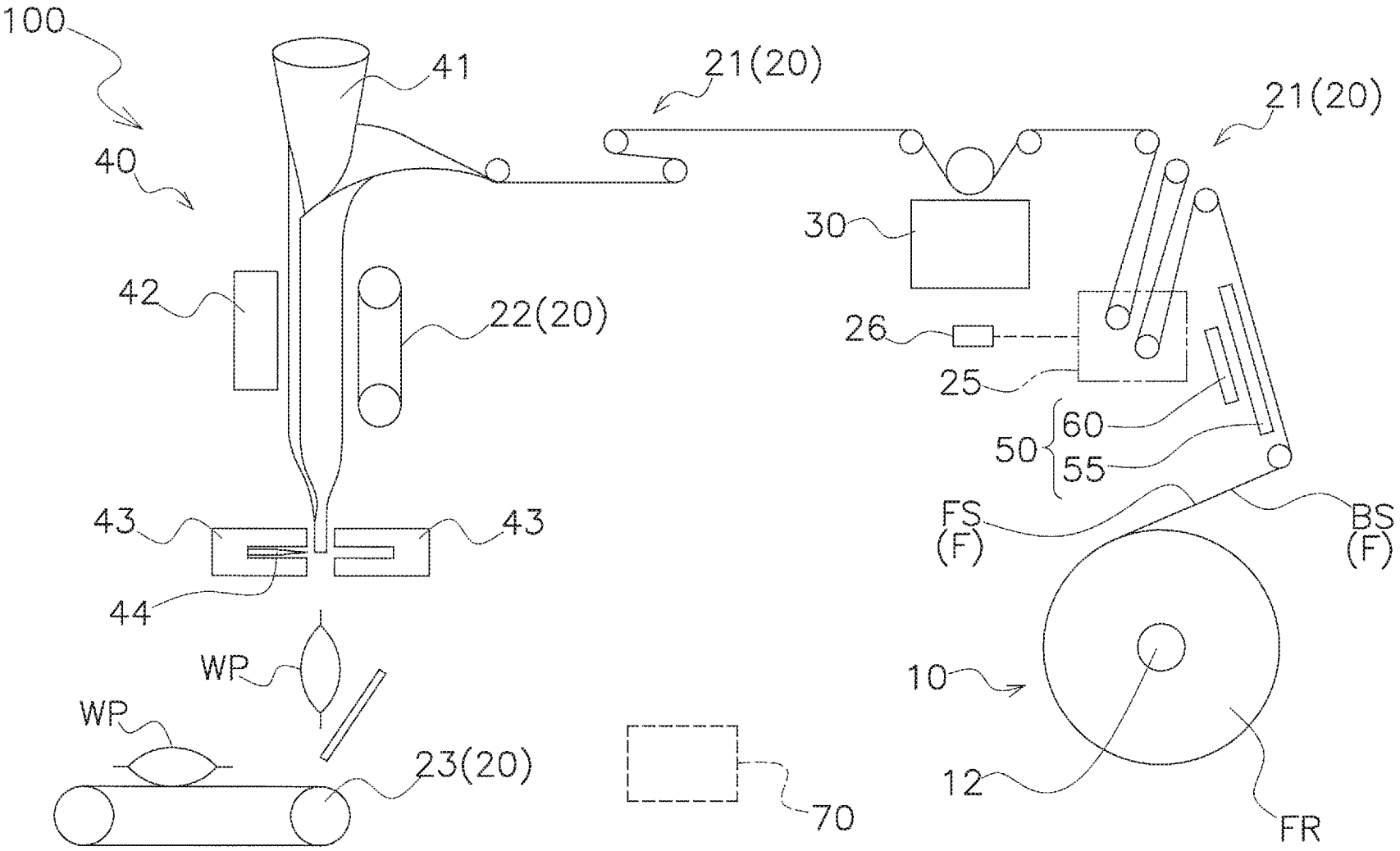
FIG. 1 is a general configuration drawing of a bag making and packaging machine according to one embodiment of the invention.
Figure 2:
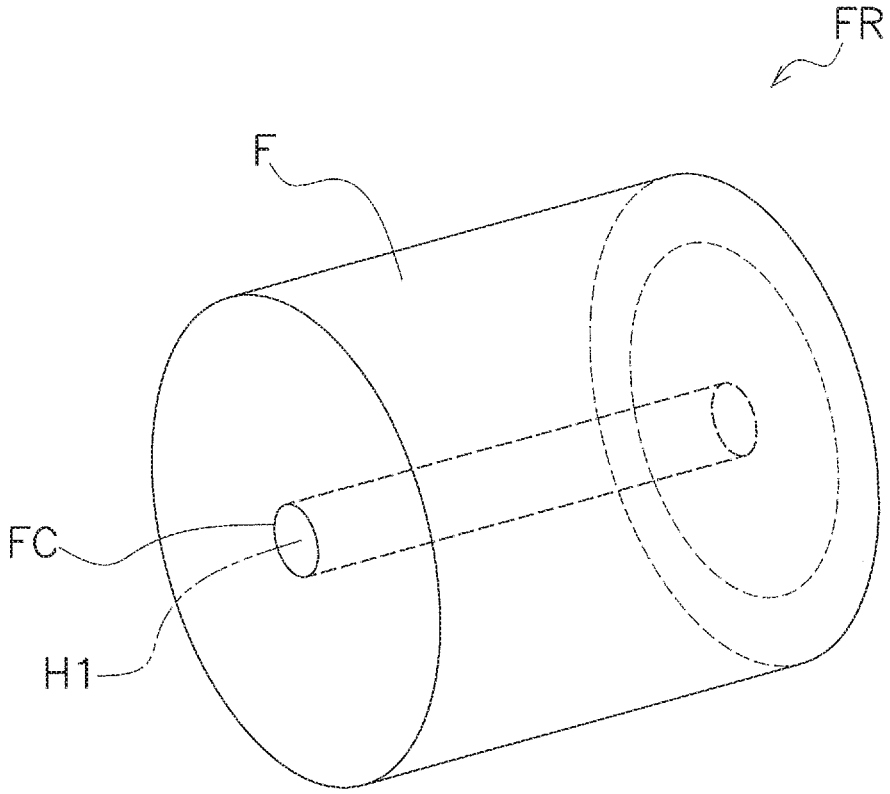
FIG. 2 is a schematic drawing showing an example of a film roll.
Figure 3:
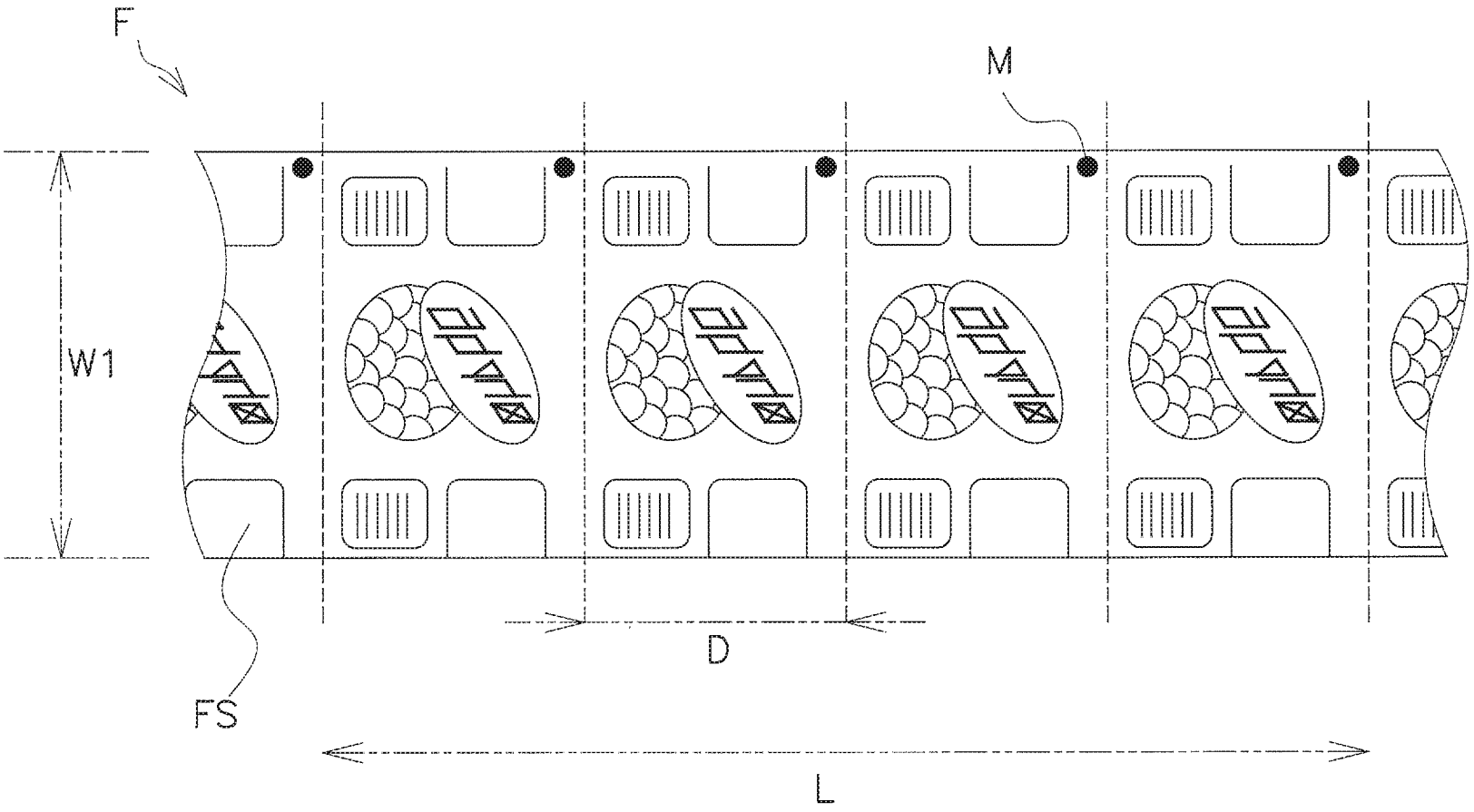
FIG. 3 is a schematic drawing showing an example of a front side of film.

FIG. 1 is a general configuration drawing of the bag making and packaging machine 100 according to one embodiment of the invention. FIG. 2 is a schematic drawing showing an example of a film roll FR used in the bag making and packaging machine 100. FIG. 3 is a schematic drawing showing an example of a front side FS of film F.

The bag making and packaging machine 100 is a machine that forms the film F fed from the film roll FR, seals the film F in a predetermined position, fills the film F with a product, then seals the film F again to thereby make a bag, and thereafter discharges the bag as a wrapped product WP.

The film roll FR used in the bag making and packaging machine 100 is, as shown in FIG. 2, configured as a result of the long film F being wound around a tubular film core FC. The film roll FR includes a type where the film F is secured by an adhesive or the like to the film core FC (a secured type) and a type where the film F is not secured to the film core FC (an unsecured type).

It will be noted that in the following description "starting end of the film roll FR" will mean the one end on the outside (the conveyance direction side) of the film F wound around the film core FC. Furthermore, "terminal end of the film roll FR" will mean the one end on the inside (the side in contact with the film core FR) of the film F wound around the film core FC.

The film F, as shown in FIG. 3, extends long in a longitudinal direction L and has a fixed width W1 extending in a transverse direction perpendicular to the longitudinal direction L. A design (characters, figures, or colors) for use as a bag for product packaging is repeatedly printed every dimension D on the film F. Furthermore, marks M are printed at intervals equal to the dimension D in the longitudinal direction L on the film F. A design of characters and marks is not printed on a back side BS of the film F; rather, the back side BS is blank. The film F includes, for example, film whose front side can normally be seen through the film from the back side (translucent) and film (e.g., aluminum-deposited film) in which characters or figures printed on the front side are visible from the back side when strong light is projected onto the film.

In the bag making and packaging machine 100, the film F is conveyed to the downstream side in a posture where the back side BS faces the outward direction (mainly the upward direction) of the bag making and packaging machine 100 and the front side FS faces the inward direction (mainly the downward direction) of the bag making and packaging machine 100. The film F is processed into the shape of a bag in the process of being conveyed in the bag making and packaging machine 100. After the film F has been processed into a bag, the dimension D becomes the distance between the top side and the bottom side of the bag or the distance between the left side and the right side of the bag.

The bag making and packaging machine 100 mainly has a film roll support unit 10, a conveyance unit 20, a printing unit 30, a bag making unit 40, a film joining work aiding unit 50, and a control unit 70.

The film roll support unit 10 supports the film roll FR in such a way that the film roll FR may freely rotate. The film roll support unit 10 is disposed most upstream on the conveyance path of the film F in the bag making and packaging machine 100. The film roll support unit 10 has a shaft 12 and a shaft motor (not shown in the drawings) that causes the shaft 12 to rotate. The film roll FR is mounted on the shaft 12 by inserting the shaft 12 into a center hole H1 in the film roll FR (i.e., the film core FC). The shaft 12 is connected to an output shaft of the shaft motor and rotates in conjunction with the driving of the shaft motor. The operation (rotational speed) of the shaft motor is controlled by the control unit 70.

The conveyance unit 20 conveys, to the downstream side of the conveyance path (including the bag making unit 40), the film F fed from the film roll FR. The conveyance unit 20 includes plural rollers 21, a pulldown belt 22, and a discharge conveyor 23 and the like. The conveyance unit 20 conveys the film F as a result of each part carrying out predetermined operations. The plural rollers 21 are disposed mainly between the film roll support unit 10 and the bag making unit 40. The pulldown belt 22 is disposed between the plural rollers 21 and the discharge conveyor 23. The discharge conveyor 23 is disposed most downstream on the conveyance path. The operations of each part in the conveyance unit 20 are controlled by the control unit 70.

The rollers 21 included in the conveyance unit 20 include tension rollers 25 (see the long dashed double-short dashed lines in FIG. 1). The tension rollers 25 apply predetermined tension to the film F by moving in the vertical direction. In a case where the tension that the tension rollers 25 receive from the film F is greater than the tension that the tension rollers 25 apply to the film F, the tension rollers 25 move in the vertically upward direction. Conversely, in a case where the tension that the tension rollers 25 receive from the film F is lesser than the tension that the tension rollers 25 apply to the film F, the tension rollers 25 move in the vertically downward direction. The movement of the tension rollers 25 in the up and down direction is detected by an encoder 26, and a signal corresponding to the detection result is appropriately sent to the control unit 70. The control unit 70 calculates the tension in the film F using the signal sent from the encoder 26.

The printing unit 30 prints predetermined information, such as the date of manufacture, in predetermined positions on the film F being conveyed. The operation of the printing unit 30 is controlled by the control unit 70.

The bag making unit 40 is a unit that processes the film F to make bags. The bag making unit 40 includes a former 41, a longitudinal sealing unit 42, a transverse sealing unit 43, a cutting unit 44 and the like. The former 41 makes round the film F conveyed thereto in a flat state and puts the two longitudinal sides of the film F on top of each other. The longitudinal sealing unit 42 seals the two longitudinal sides of the film F that have been put on top of each other by the former 41. The transverse sealing unit 43 seals, in a predetermined position and in such a way that the sealing direction substantially perpendicularly intersects the sealing direction in the longitudinal sealing unit 42, the film F that has traveled through the longitudinal sealing unit 42 and been formed into a tubular shape. The film F that has been sealed by the transverse sealing unit 43 is filled with one bag's worth of product via the former 41, and thereafter the transverse sealing unit 43 seals the opening through which the film F was filled with the product. The cutting unit 44 cuts, in a predetermined position, the film F that has undergone the sealing process in the transverse sealing unit 43. The operations of each part in the bag making unit 40 are controlled by the control unit 70.

The article including the film that has been made into a bag and filled with the product as a result of traveling through the bag making unit 40 is discharged to the outside by the discharge conveyor 23 of the conveyance unit 20.

The film joining work aiding unit 50 is a unit for aiding work according to replacement of the film roll FR. In the bag making and packaging machine 100, when the film roll FR reaches its terminal end, replacement of the film roll FR is carried out in a state in which the bag making and packaging machine 100 is shut down. When replacing the film roll FR, a new film roll FR is mounted in the film roll support unit 10, and thereafter film joining work of joining the terminal end of the film roll FR before replacement and the starting end of the film roll FR after replacement is carried out. The film joining work aiding unit 50 is disposed to facilitate this film joining work. The film joining work aiding unit 50 includes a work table 55 and a light projection unit 60.

The work table 55 is a tabular member made of metal or made or synthetic resin. The work table 55 aids the work of joining the terminal end of the film roll FR before replacement and the starting end of the film roll FR for replacement when replacing the film roll FR. Specifically, the work table 55 fulfills a roll as a work table for carrying out the film joining work. The work table 55 is positioned between the film roll support unit 10 and the conveyance unit 20.

The light projection unit 60 projects light for the worker to check, from the back side BS, the design printed on the front side FS of the film F. Specifically, the light projection unit 60 illuminates, from the direction of the front side FS, the film F positioned on the work table 55 (i.e., positioned between the film roll support unit 10 and the conveyance unit 20). The light projection unit 60 includes plural light emitting components 61 (see FIG. 8) configured by LED lights, for example, and a switch component 62 (see FIG. 9) configured by a semiconductor switch or a relay, for example.

The switch component 62 is switched between a conducting state and a non-conducting state by the control unit 70. When the switch component 62 is switched to the conducting state, the light emitting components 61 are supplied with predetermined drive power from a power unit (not shown in the drawings) via the switch component 62 and emit light. When the switch component 62 is switched to the non-conducting state, the drive power supplied from the power unit is cut off and the light emitting components 61 stop emitting light. The light emitting components 61 are disposed in positions in which they are capable of illuminating, from the front side FS, the film F at the joined section of the film F (i.e., on the work table 55).

The control unit 70 is a microcomputer including a memory, such as a RAM, a ROM or the like and a CPU. The control unit 70 appropriately controls the operations and states of each unit included in the bag making and packaging machine 100 in accordance with a control program stored in the memory.

(2) Details of Film Joining Work Aiding Unit 50

Figure 4:
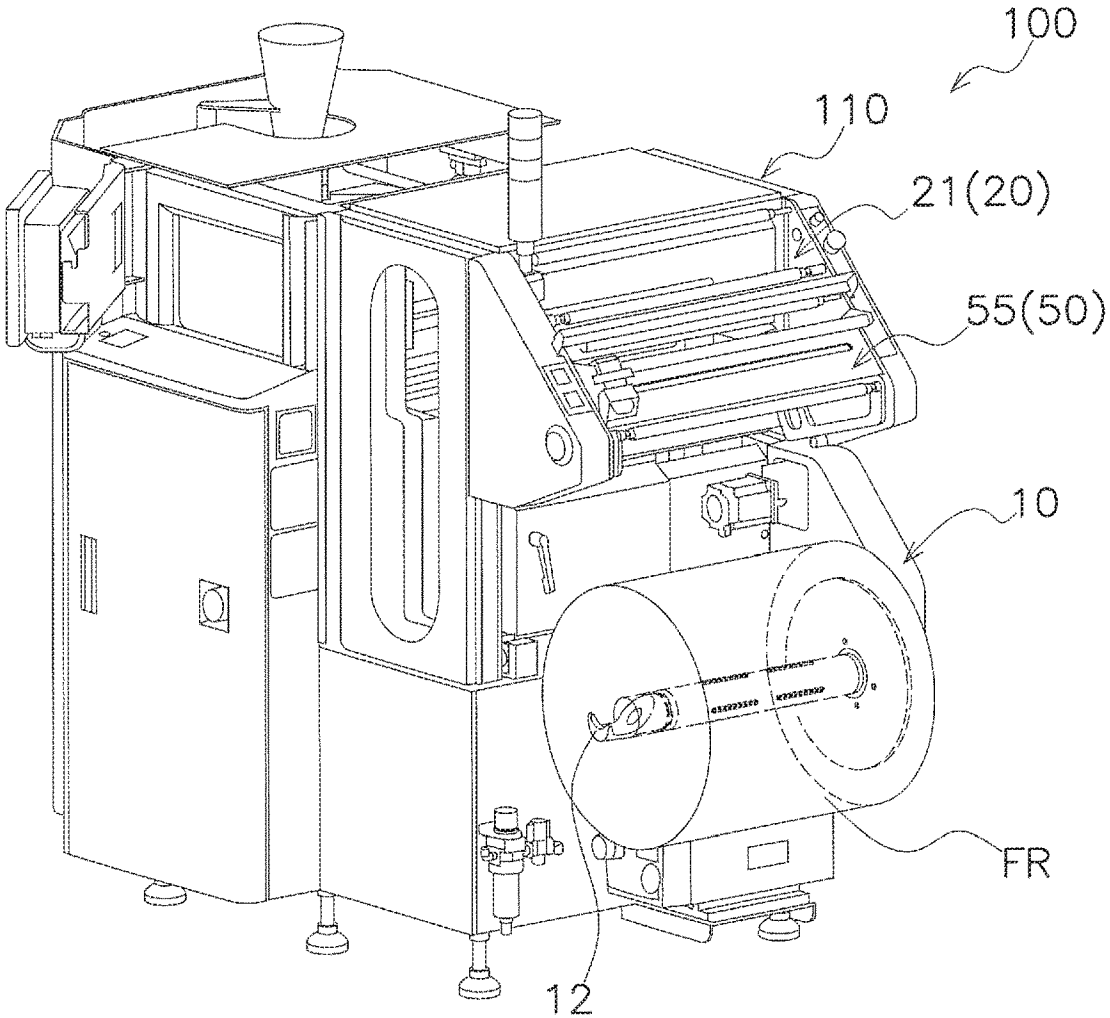
FIG. 4 is a perspective view of the bag making and packaging machine.
Figure 4:
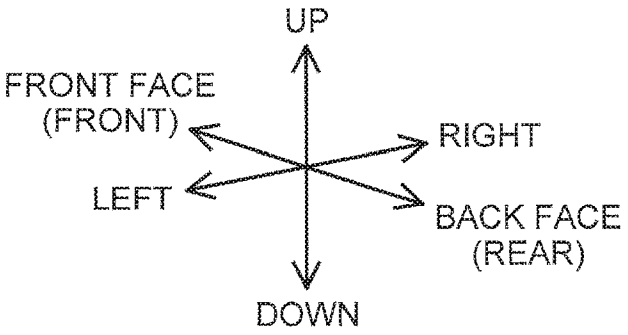
Figure 5:
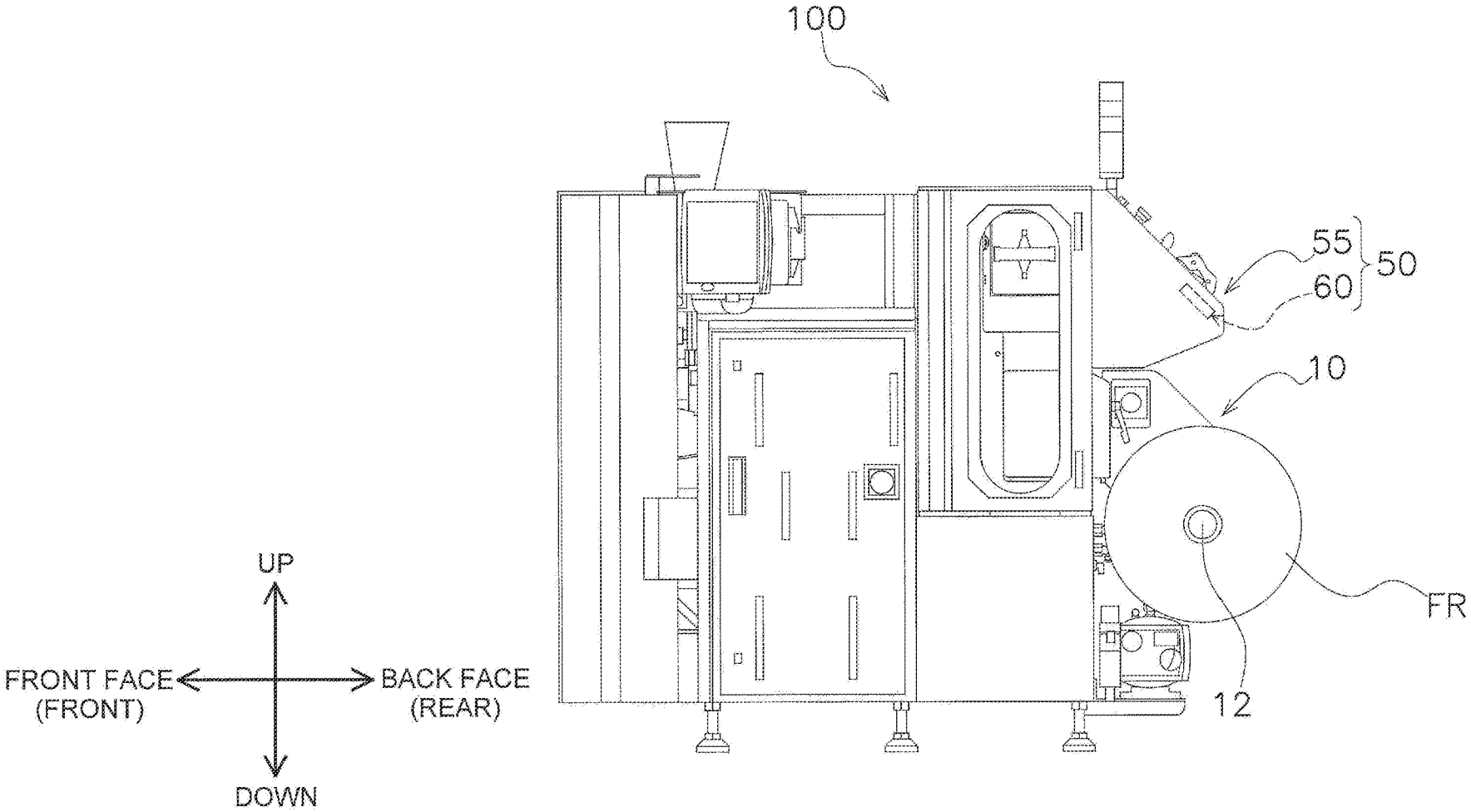
FIG. 5 is a left side view of the bag making and packaging machine.
Figure 6:
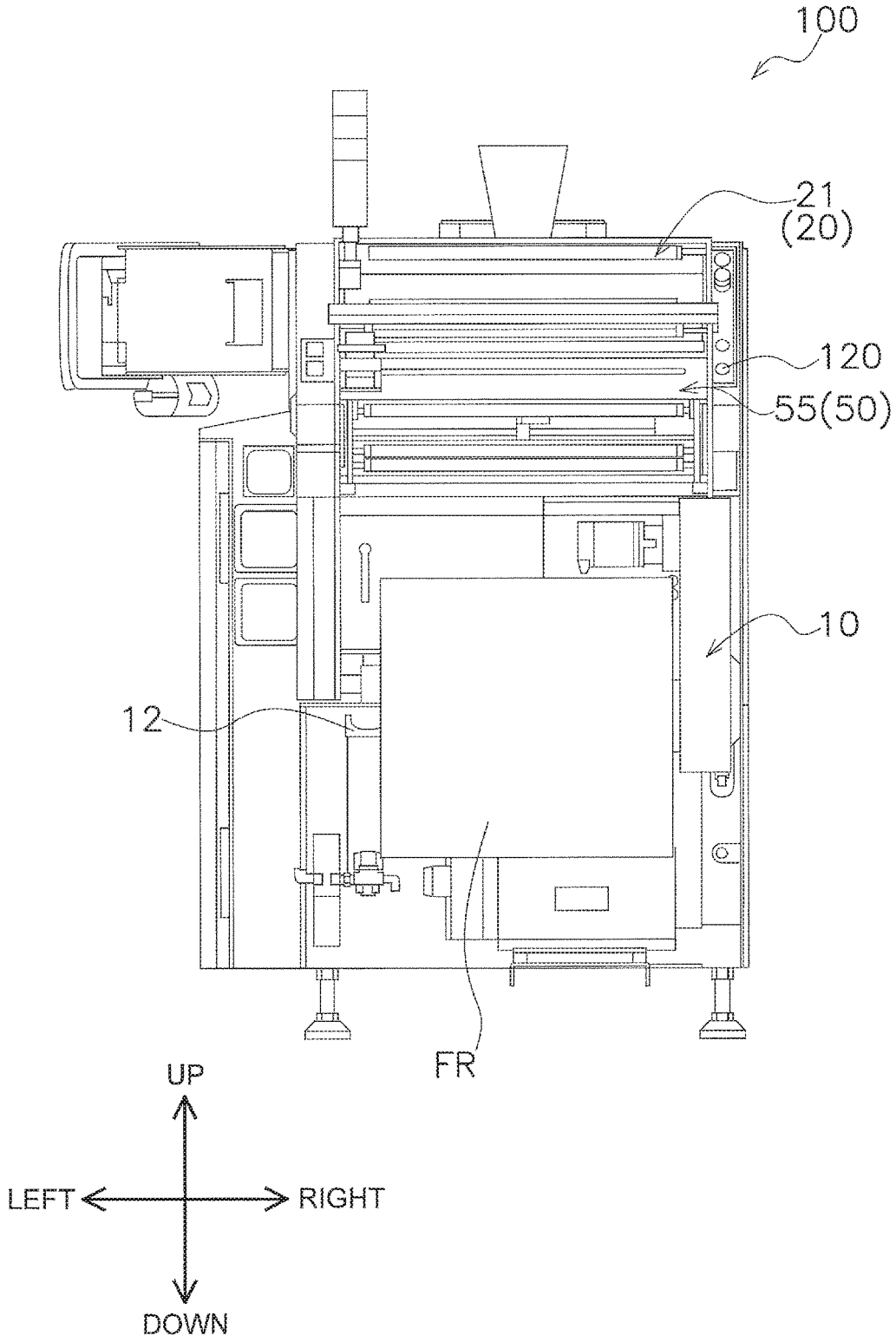
FIG. 6 is a back view of the bag making and packaging machine.
Figure 7:
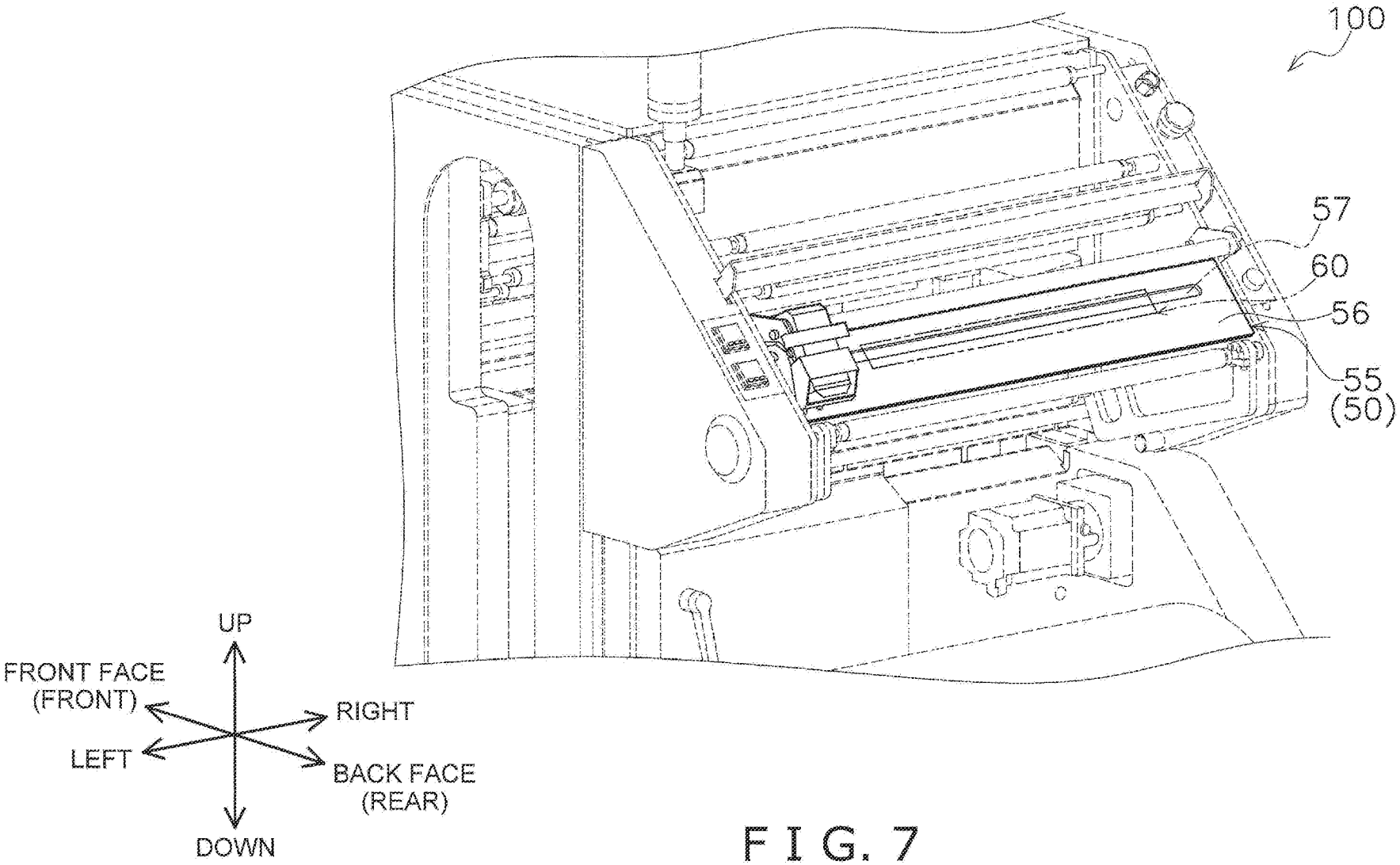
FIG. 7 is an enlarged view of the area around a work table shown in FIG. 4.
Figure 8:
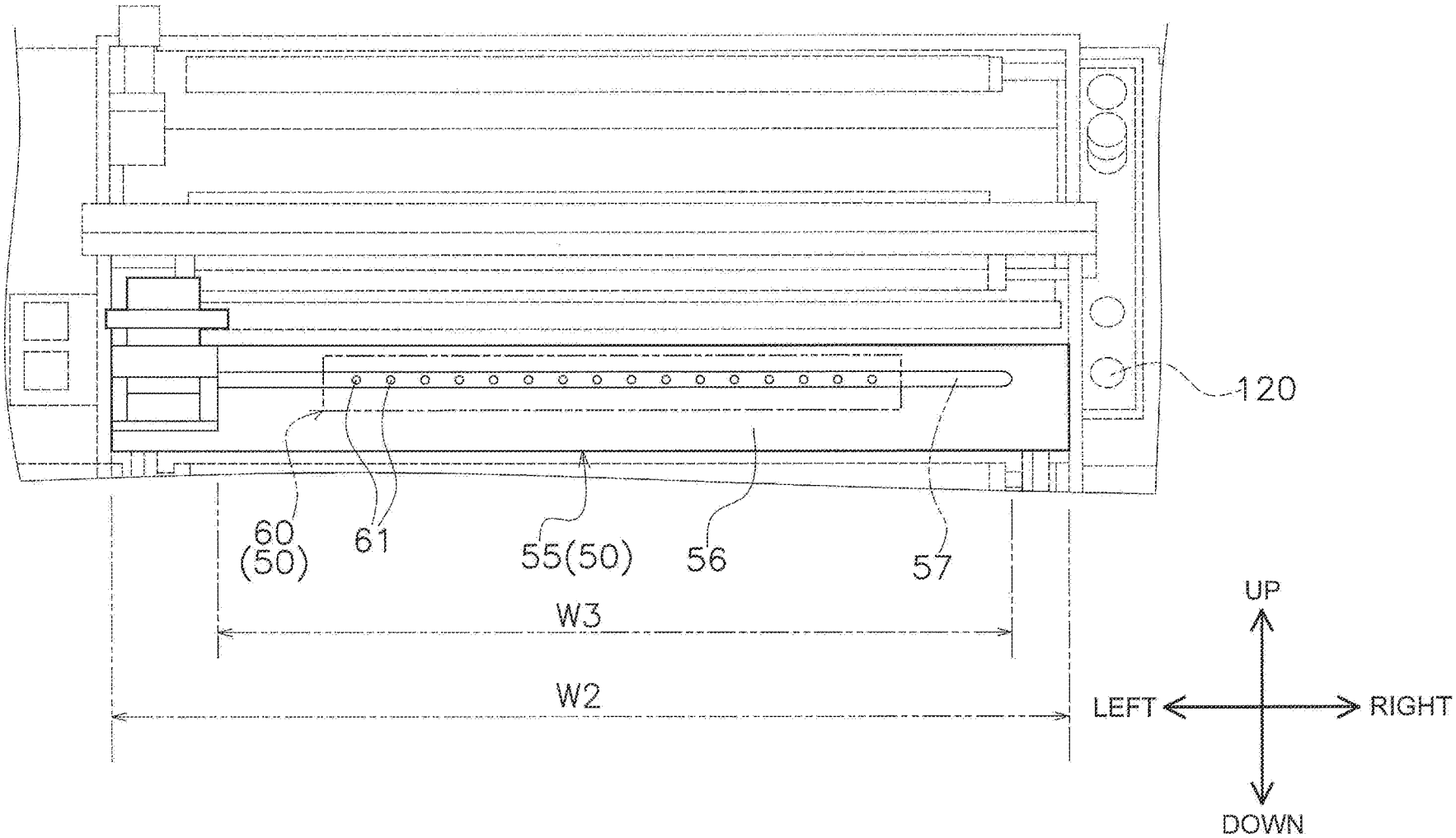
FIG. 8 is an enlarged view of the area around the work table shown in FIG. 6.

FIG. 4 is a perspective view of the bag making and packaging machine 100. FIG. 5 is left side view of the bag making and packaging machine 100. FIG. 6 is a back view of the bag making and packaging machine 100. FIG. 7 is an enlarged view of the area around the work table 55 shown in FIG. 4. FIG. 8 is an enlarged view of the area around the work table 55 shown in FIG. 6. It will be noted that in FIG. 7 and FIG. 8, for convenience of description, the film joining work aiding unit 50 is indicated by solid lines or long dashed double-short dashed lines while other sections are indicated by dashed lines.

(2-1) Work Table 55

The work table 55 is secured to a body frame 110 of the bag making and packaging machine 100. The work table 55 is disposed above the film roll support unit 10 on the back side of the bag making and packaging machine 100.

The work table 55 has, on its upper surface section, a flat portion 56 that extends in the left-right direction (i.e., the width W1 direction of the film). A width W2 of the flat portion 56 (see FIG. 8) is greater than the width W1 of the film F. The flat portion 56 faces the front side FS of the film F fed from the film roll FR. A slit 57 that extends in the left-right direction (i.e., the width W1 direction of the film) is formed in the flat portion 56. A width W3 of the slit 57 (see FIG. 8) is greater than the width W1 of the film.

(2-2) Light Projection Unit 60

The light projection unit 60 is disposed in a space below the work table 55 (more specifically, the flat portion 56). Specifically, plural (here, sixteen) light emitting components 61 are disposed below the flat portion 56. More specifically, each of the light emitting components 61 is arranged side by side in the left-right direction (i.e., the width W1 direction of the film) every predetermined interval directly below the slit 57. By virtue of being disposed in this way, the light projection unit 60 is compactly housed without occupying a large space inside the body frame 110 of the bag making and packaging machine 100. For this reason, the light projection unit 60 can also be housed inside the body frame of an existing (conventional) bag making and packaging machine.

Each of the light emitting components 61 is disposed in such a way that their main projection direction when they emit light extends outward through the slit 57. Because of this, when the light emitting components 61 emit light, the projected light travels through the slit 57. That is, the film F that is on the slit 57 in the work table 55 can be illuminated by the light traveling through the slit 57. Although it will be described later, the light emitting components 61 blink in a case where the film roll FR has reached its terminal end.

The switch component 62 is switched between the conducting state and the non-conducting state as a result being supplied with the drive voltage from the control unit 70.

(3) Details of Control Unit 70

Figure 9:
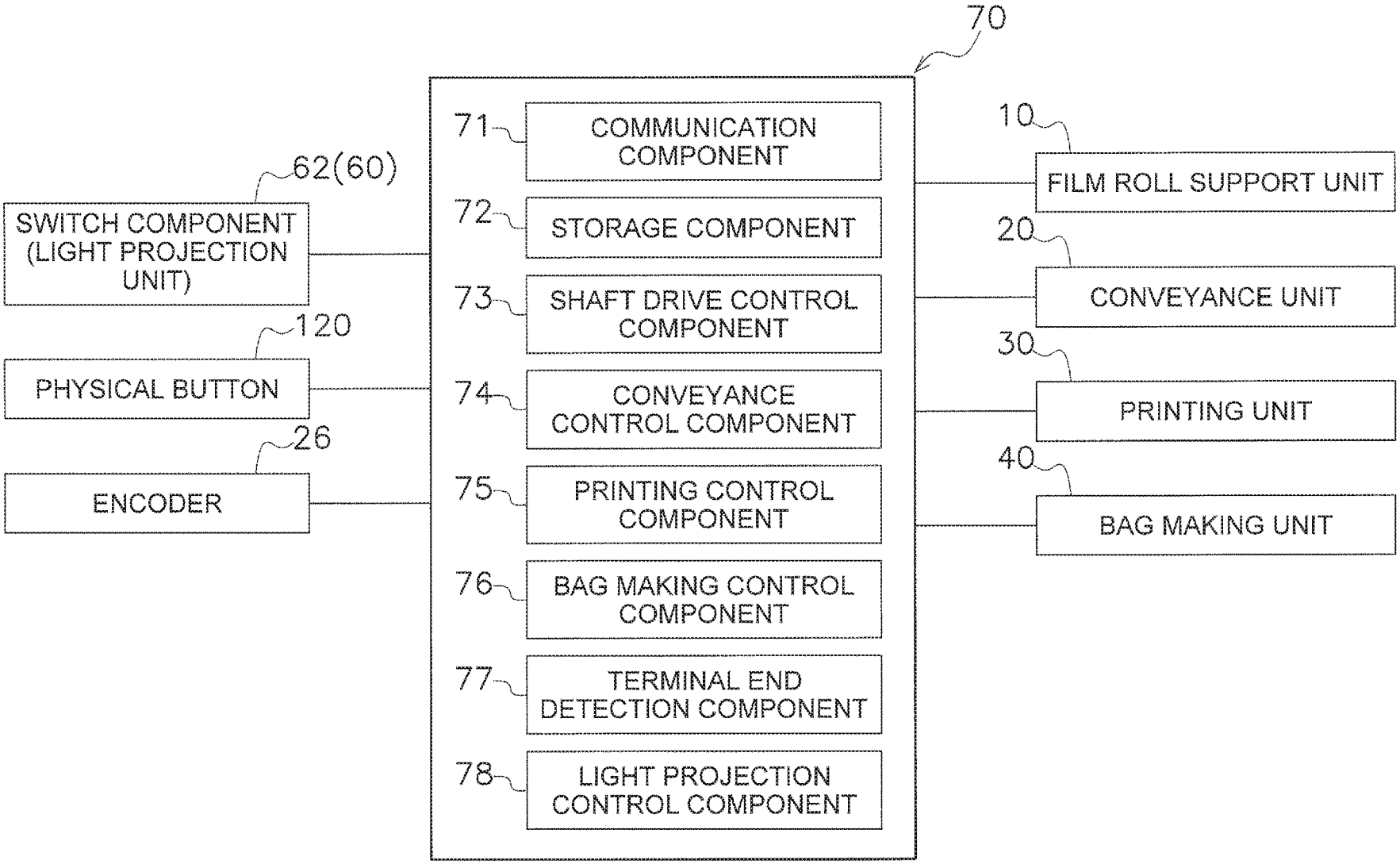
FIG. 9 is a block diagram showing a control unit and units electrically connected to the control unit.

FIG. 9 is a block diagram showing the control unit 70 and units electrically connected to the control unit 70.

The control unit 70 is housed inside an electrical component box (not shown in the drawings) secured to the body frame 110 of the bag making and packaging machine 100. The control unit 70 is electrically connected to actuators and various types of sensors included in the film roll support unit 10, the conveyance unit 20, the printing unit 30, and the bag making unit 40, and sends signals to and receives signals from each unit. Furthermore, the control unit 70 is electrically connected to the switch component 62 of the light projection unit 60, a physical button 120, and the encoder 26, and sends signals to and receives signals from each unit.

The control unit 70 mainly has a communication component 71, a storage component 72, a shaft drive control component 73, a conveyance control component 74, a printing control component 75, a bag making control component 76, a terminal end detection component 77, and a light projection control component 78.

The communication component 71 is a functional component that sends signals to the other units and receives signals from the other units.

The storage component 72 is configured by a RAM, a ROM or the like, and includes a volatile storage region and a nonvolatile storage region. The storage component 72 stores the control program used in processing by each component.

The shaft drive control component 73 controls the powering on/off and the rotational speed of the film roll support unit 10 (shaft motor) in accordance with the control program.

The conveyance control component 74 controls the operations of each part (the pulldown belt 22 and the discharge conveyor 23, etc.) in the conveyance unit 20 in accordance with the control program.

The printing control component 75 controls the operation of the printing unit 30 in accordance with the control program.

The bag making control component 76 controls the operations of each unit (the longitudinal sealing unit 42, the transverse sealing unit 43, and the cutting unit 44, etc.) in the bag making unit 40 in accordance with the control program.

The terminal end detection component 77 determines whether or not the film roll FR mounted in the film roll support unit 10 has reached its terminal end. Specifically, the terminal end detection component 77 monitors the tension acting on the film F in accordance with the detection value of the encoder 26 (based on the position of the tension rollers 25 in the vertical direction) and detects the terminal end of the film roll FR from changes in the tension. The terminal end detection component 77 determines that the film roll FR has reached its terminal end based, for example, on the fact that the tension acting on the tension rollers 25 has temporarily become greater.

It will be noted that "detects the terminal end of the film roll FR" here includes, for example, detecting the instant when, in regard to a type of film roll FR where the terminal end of the film F and the film core FC are secured to each other (a secured type), the film F has become unable to be fed any further. Furthermore, this also includes detecting the instant when, in regard to a type of film roll FR where the terminal end of the film F and the film core FC are not secured to each other (a non-secured type), the film F has come away from the film core FC.

The light projection control component 78 controls the state of the switch component 62 of the light projection unit 60 in accordance with the control program. When the physical button 120 is pressed down, the light projection control component 78 supplies a drive voltage in order to switch the switch component 62 to the conducting state. Because of this, the drive power is supplied via the switch component 62 to the light emitting components 61, and the light emitting components 61 are switched to a light emitting state.

Furthermore, when the physical button 120 is pressed down in a case where the switch component 62 is in the conducting state, the light projection control component 78 stops supplying the drive voltage in order to switch the switch component 62 to the non-conducting state. Because of this, the drive power that had been supplied via the switch component 62 to the light emitting components 61 is cut off, and the light emitting components 61 are switched to a non-light emitting state (a state in which they do not emit light).

Furthermore, in a case where the terminal end detection component 77 has detected the terminal end of the film roll FR, the light projection control component 78 intermittently supplies the drive voltage in order to switch the switch component 62 between the conducting state and the non-conducting state every predetermined time period. Because of this, the light emitting components 61 are switched to a blinking state in which they alternate between the light emitting state and the non-light emitting state every predetermined time period. As a result, the user can visually recognize that the film roll FR has reached its terminal end.

When the physical button 120 is pressed down in a case where the light emitting components 61 are in the blinking state, the light projection control component 78 stops supplying the drive voltage it had intermittently supplied in order to switch the light emitting components 61 to the non-light emitting state. Because of this, the light emitting components 61 are switched to the non-light emitting state.

(4) Main Functions of Bag Making and Packaging Machine 100

The bag making and packaging machine 100 has superior workability in the film F joining work mainly for the following reasons.

Namely, in the bag making and packaging machine 100, the film F fed from the film roll FR is fed to the downstream side (the bag making unit 40) in a state in which the back side BS of the film F faces the outside (mainly the upward direction). For this reason, in the film F joining work, it is necessary to join the films F that are in a state in which their back sides BS face the outside. In this case, it can become difficult to properly carry out the film F joining work unless some kind of mark is included on the back sides BS of the films F.

However, in the bag making and packaging machine 100, the light emitting components 61 are disposed so as to be capable of illuminating, from the direction of the front side FS, the film F positioned between the film roll support unit 10 and the conveyance unit 20. Because of this, when carrying out the film F joining work, as shown in FIG. 10 and FIG. 11, it becomes possible to join the films F while checking the characters or figures being visible by passing the light projected from the light emitting components 61 through the film F.

Figure 10:
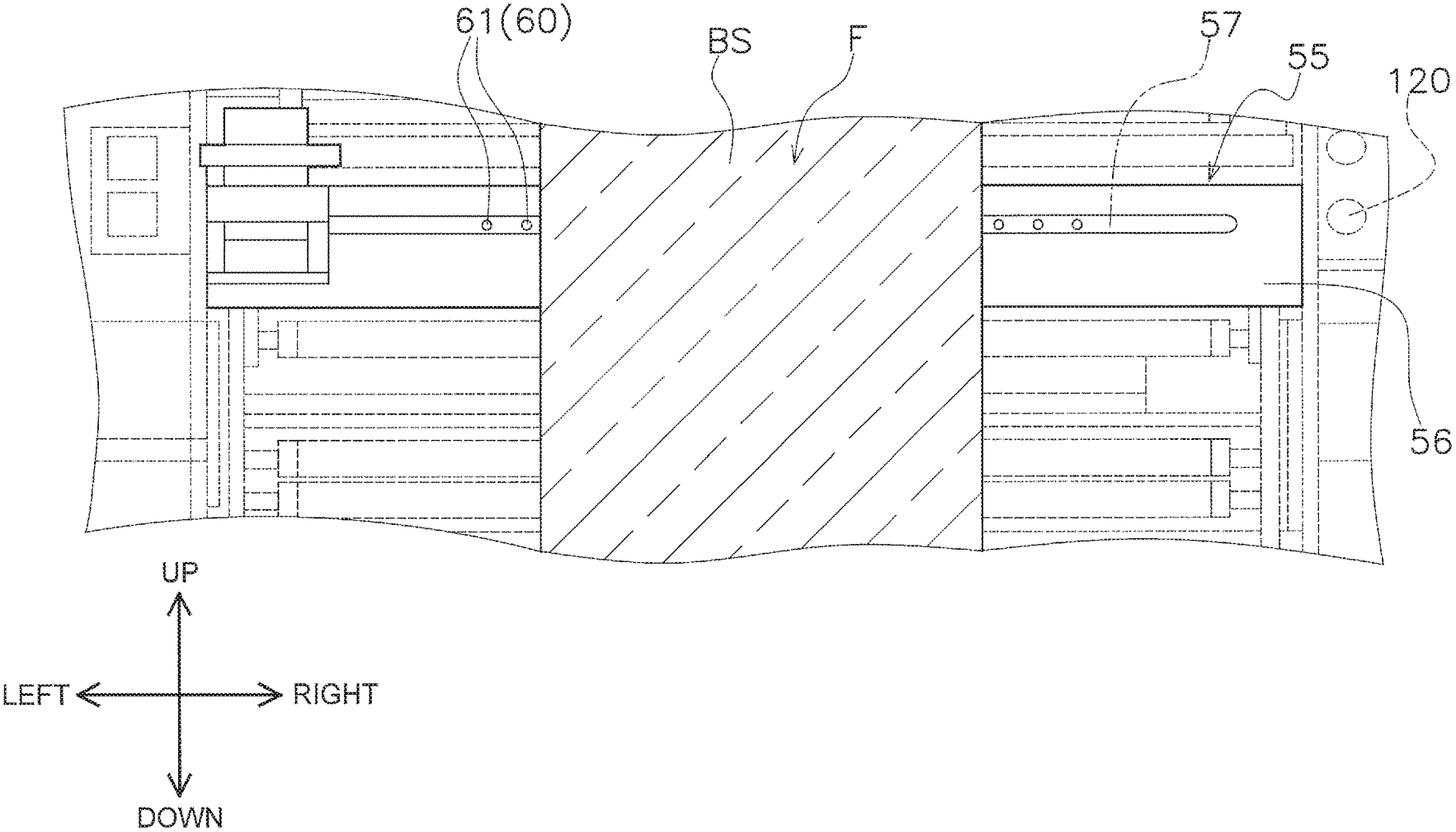
FIG. 10 is a schematic drawing showing the state of the work table and the film (back side) positioned on the work table in a case where light emitting components are in a non-light emitting state.

FIG. 10 is a schematic drawing showing the state of the work table 55 and the film F (back side BS) positioned on the work table 55 in a case where the light emitting components 61 are in the non-light emitting state. FIG. 11 is a schematic drawing showing the state of the work table 55 and the film F (back side BS) positioned on the work table 55 in a case where the light emitting components 61 are in the light emitting state. It will be noted that the hatched sections in FIG. 10 and FIG. 11 represent the back side BS (blank) of the film F.

As shown in FIG. 10, in a case where the light emitting components 61 are in the non-light emitting state, the film F is not passed through by the light, so the design printed on the front side FS cannot be checked from the back side BS.

Figure 11:
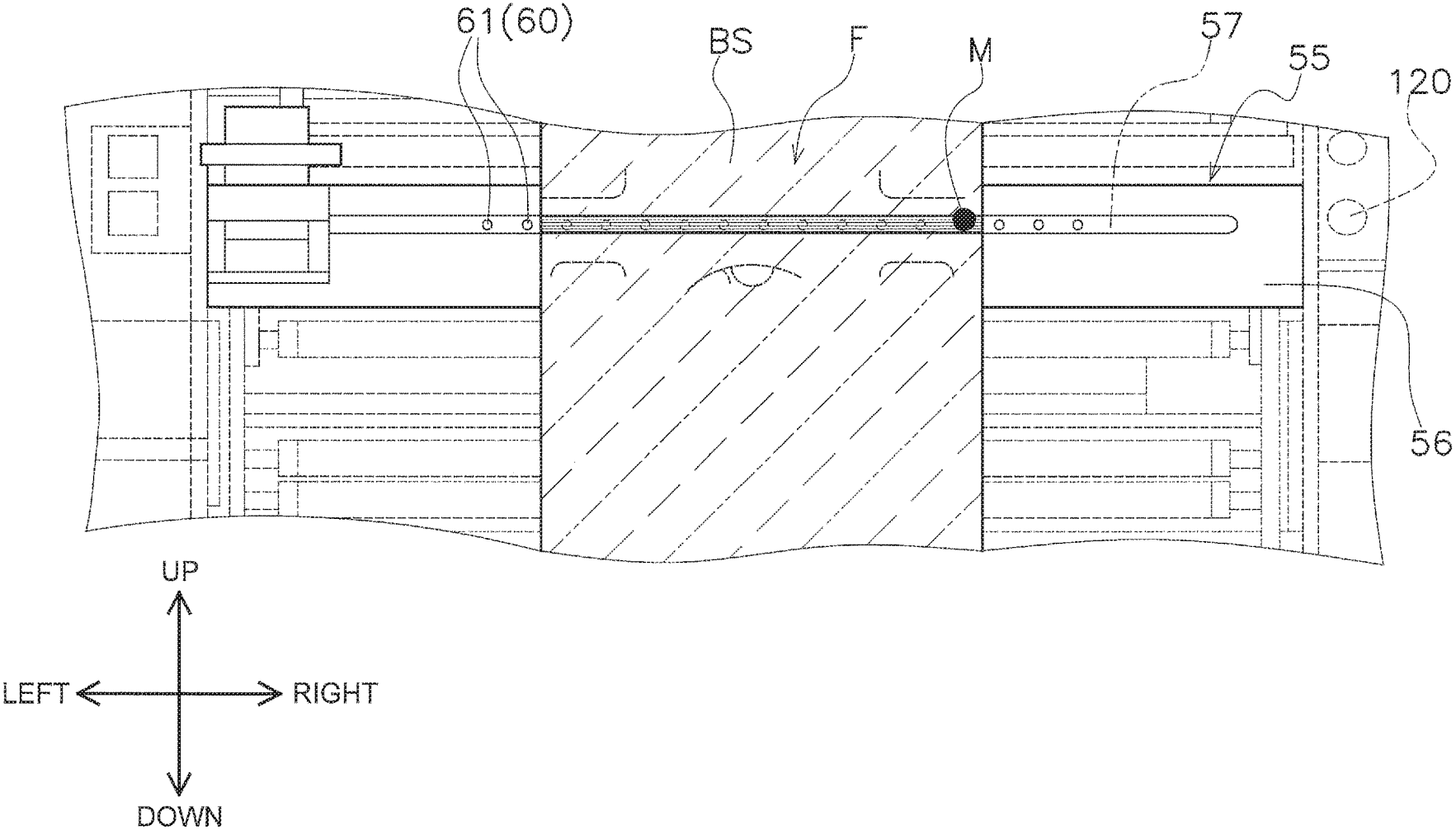
FIG. 11 is a schematic drawing showing the state of the work table and the film (back side) positioned on the work table in a case where the light emitting components are in a light emitting state.

On the other hand, as shown in FIG. 11, when the light emitting components 61 are switched to the light emitting state, the film F is passed through by the light, and the design printed on the front side FS become able to be checked from the back side BS. FIG. 11 shows a state in which the film F is passed through by the light that has traveled through the slit 57 and in which the mark M printed on the front side FS has become able to be checked from the back side BS. Because of this, it becomes possible to carry out the film F joining work while checking the design such as the mark M, and it becomes easy to properly carry out the film F joining work even in the case of joining films F that are in a state in which their back sides BS face the outside.

Thus, the bag making and packaging machine 100 has superior workability in the film F joining work.

(5) Characteristics (5-1)

In the above embodiment, the light emitting components 61 are disposed so as to be capable of illuminating, from the direction of the front side FS, the film F positioned between the film roll support unit 10 and the conveyance unit 20. Because of this, in the film F joining work when replacing the film roll FR, it is possible to join the films F while checking the characters or figures being visible by passing the light projected from the light emitting components 61 through the film F. As a result, it is easy to properly carry out the film F joining work even in a case where it is required to join films F that are in a state in which their back sides BS face up. Thus, the workability of the film F joining work is superior.

(5-2)

In the above embodiment, the light emitting components 61 are disposed so as to illuminate the film F positioned directly on the work table 55. Because of this, when the film F joining work is carried out, the characters or figures on the film F positioned on the work table 55 are visible. As a result, it is easier to properly carry out the film F joining work.

(5-3)

In the above embodiment, the light emitting components 61 are disposed below the flat portion 56 of the work table 55 so as to be capable of projecting light that travels through the slit 57 formed in the flat portion 56 and extending in the width direction of the film F. By virtue of being disposed in this way, the light emitting components 61 are compactly housed without occupying a large space inside the body frame 110 of the bag making and packaging machine 100. That is, the light emitting components 61 are compactly disposed in the space below the work table 55. As a result, a decline in the compactness of the machine body and a decline in workability caused by disposing the light emitting components 61 can be restrained.

(5-4)

In the above embodiment, the terminal end detection component 77 detects that the film roll FR has reached its terminal end, and the light emitting components 61 are configured to blink or light up in response to the terminal end detection component 77 having detected that the film roll FR has reached its terminal end. Because of this, the user can visually recognize that the film roll FR has reached its terminal end and can quickly grasp when the film roll FR needs to be replaced. As a result, it is possible to shorten the amount of time that the bag making and packaging machine 100 is stopped, and productivity can be improved.

(6) Example Modifications

The bag making and packaging machine 100 of the above embodiment can be appropriately modified as described in the following example modifications. It will be noted that each example modification may also be combined with another example modification unless inconsistency occurs.

(6-1) Example Modification A

In the above embodiment, the light emitting components 61 were configured by plural LED lights. However, the light emitting components 61 are not invariably limited to LED lights, and other components may also be employed provided that they project light. For example, fluorescent lamps or incandescent lamps may also be employed as the light emitting components 61.

(6-2) Example Modification B

In the above embodiment, the slit 57 was formed in the flat portion 56 of the work table 55 and light was projected from the light emitting components 61 through the slit 57. However, the configuration wherein the light emitting components 61 project the light is not invariably limited to this. For example, the flat portion 56 of the above embodiment may also be configured by a transparent or translucent material such as synthetic resin or glass as a flat portion 56*a*, the light emitting components 61 may be appropriately disposed below the flat portion 56*a*, and the light emitting components 61 may project the light in such a way that the light passes through the flat portion 56*a*. In this case, the slit 57 can be omitted.

According to this configuration also, effects that are the same as those of the above embodiment are achieved. That is, when carrying out the film F joining work, as shown in FIG. 12 and FIG. 13, it becomes possible to join the films F while checking the characters or figures being visible by passing the light projected from the light emitting components 61 through the films F.

Figure 12:
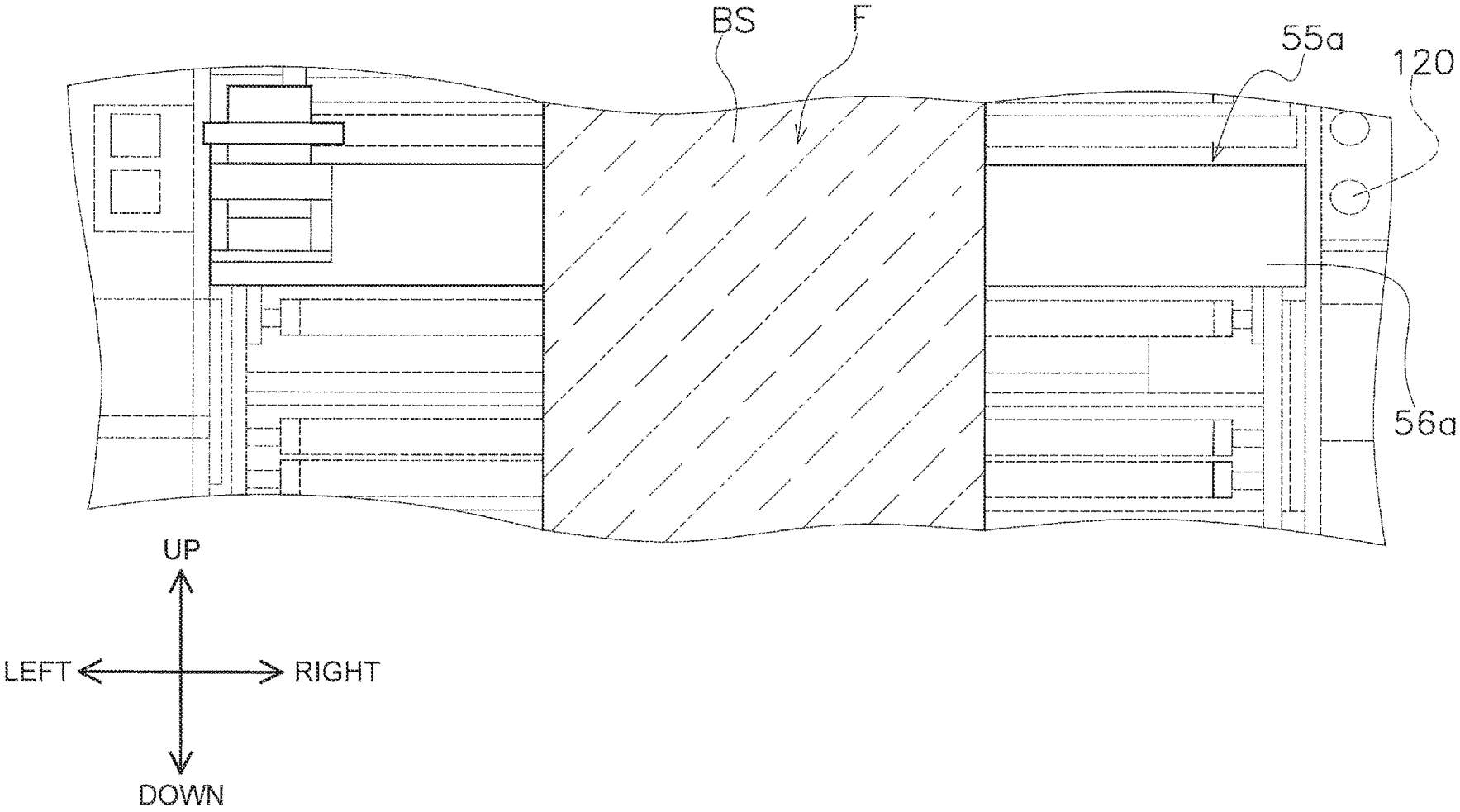
FIG. 12 is a schematic drawing showing the state of a work table and the film (back side) positioned on the work table in a case where the light emitting components are in the non-light emitting state in example modification B.

FIG. 12 is a schematic drawing showing the state of a work table 55*a* and the film F (back side BS) positioned on the work table 55*a* in a case where the light emitting components 61 are in the non-light emitting state. FIG. 13 is a schematic drawing showing the state of the work table 55*a* and the film F (back side BS) positioned on the work table 55*a* in a case where the light emitting components 61 are in the light emitting state. It will be noted that the hatched sections in FIG. 12 and FIG. 13 represent the back side BS (blank) of the film F.

As shown in FIG. 12, in a case where the light emitting components 61 are in the non-light emitting state, the film F is not passed through by the light, so the design printed on the front side FS cannot be checked from the back side BS.

Figure 13:
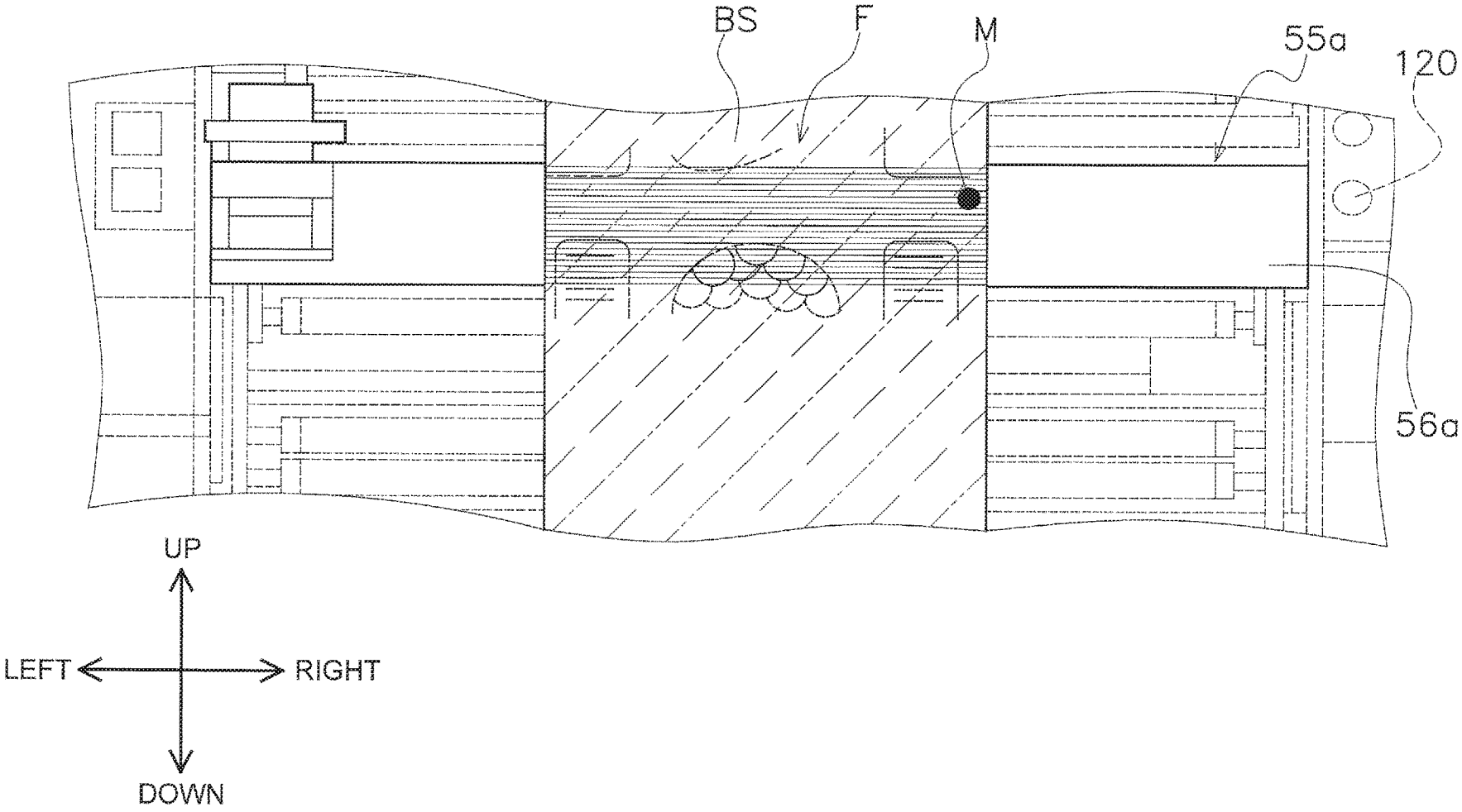
FIG. 13 is a schematic drawing showing the state of the work table and the film (back side) positioned on the work table in a case where the light emitting components are in the light emitting state in example modification B.

On the other hand, as shown in FIG. 13, when the light emitting components 61 are switched to the light emitting state, the film F is passed through by the light, and the design printed on the front side FS becomes able to be checked from the back side BS. FIG. 13 shows a state in which the film F is passed through by the light that has traveled through the flat portion 56*a* and in which the mark M and other designs printed on the front side FS have become able to be checked from the back side BS. Because of this, it becomes possible to carry out the film F joining work while checking the design such as the mark M, and it becomes easy to properly carry out the film F joining work even in the case of joining films F that are in a state in which their back sides BS face the outside.

(6-3) Example Modification C

In the above embodiment, the light emitting components 61 were disposed in the space below the flat portion 56 of the work table 55. However, the light emitting components 61 do not invariably need to be disposed in this way and may also be disposed in another space. For example, the light emitting components 61 may also be configured in the shape of a panel and disposed on the flat portion 56. Furthermore, the light emitting components 61 may also be disposed, such that their projection direction can be varied, in the vicinity of either the left or right end portion of the flat portion 56.

(6-4) Example Modification D

In the above embodiment, the light emitting components 61 were disposed so as to be capable of illuminating, from the front side FS, the film F positioned on the work table 55 (the flat portion 56). However, the light emitting components 61 do not invariably need to be disposed in this way. For example, the light emitting components 61 may also be disposed so as to be capable of illuminating, from the front side FS, the film F positioned between the film roll support unit 10 and the work table 55.

(6-5) Example Modification E

In the above embodiment, the light emitting components 61 were configured to blink in response to the terminal end detection component 77 having detected the terminal end of the film roll FR. However, in this case, the light emitting components 61 may also be configured to simply light up rather than blink. That is, the light projection control component 78 may also be configured to supply the drive voltage continuously rather than intermittently.

(6-6) Example Modification F

In the above embodiment, the color of the light emitted by the light emitting components 61 was not particularly limited, but it is good for the color to be appropriately selected in accordance with the design on the film F and so forth.

(6-7) Example Modification G

In the above embodiment, the terminal end detection component 77 detected the terminal end of the film roll FR based on the signal output from the encoder 26 (i.e., the tension in the film F calculated based on the amount of change in the tension rollers 25). However, the method by which the terminal end detection component 77 detects the terminal end of the film roll FR can be appropriately changed, and another known technique may also be employed. For example, an encoder may be attached to the shaft 12 or the other rollers 21, and the terminal end detection component 77 may be configured to detect the terminal end of the film roll FR based on a signal sent from that encoder. Furthermore, a sensor or camera that directly detects the terminal end of the film roll FR may be disposed, and the terminal end detection component 77 may be configured to detect the terminal end of the film roll FR based on a signal sent from these devices.

(6-8) Example Modification H

In the above embodiment, the light emitting components 61 were switched between the light emitting state and the non-light emitting state as a result of the light projection control component 78 switching the switch component 62 between the conducting state and the non-conducting state. However, the light emitting components 61 are not limited to this; a mechanical switch may be disposed, and the light emitting components 61 may be configured to be switched between the light emitting state and the non-light emitting state in response to this switch between switched on and off.

(6-9) Example Modification I

In the above embodiment, the control unit 70 was housed in the electrical component box (not shown in the drawings) secured to the body frame 110 of the box making and packaging machine 100. However, the disposition of the control unit 70 is not invariably limited to this and can be appropriately changed. For example, part or all of the control unit 70 may also be disposed in a remote location connected by a network such as a LAN or a WAN.

INDUSTRIAL APPLICABILITY

Certain implementations are applicable to a bag making and packaging machine.

The invention claimed is:

1. A bag making and packaging machine that uses a film having at least one character or figure repeatedly printed for a predetermined dimension on a front side of the film and having no character or figure on a back side of the film, the bag making and packaging machine comprising:

a film roll support unit configured to support a film roll in which the film is wound in a roll;

a bag making unit configured to process the film to make bags;

a conveyance unit positioned between the film roll support unit and the bag making unit and configured to feed the film to the bag making unit; and a light projection unit configured to illuminate, from the front side, the film positioned between the film roll support unit and the conveyance unit, and project light which passes through the at least one character or figure printed on the front side of the film, the light projection unit further configured to illuminate at least both ends of the film in a width direction of the film and outside of the both ends of the film in the width direction of the film, the conveyance unit configured to convey the film to a downstream side of the bag making and packaging machine in an area between the film roll and the bag making unit in a posture where the back side of the film faces an outward direction of the bag making and packaging machine and the front side of the film faces an inward direction of the bag making and packaging machine such that the light passes through the film in a state in which the light projection unit projects the light and the at least one character or figure printed on the front side of the film is detectable from the back side of the film at least at the both ends of the film in the width direction of the film.

2. The bag making and packaging machine according to claim 1, further comprising a work table positioned between the film roll support unit and the conveyance unit and configured to aid in joining a terminal end of the film roll and a starting end of a new film roll for replacement when replacing the film roll, wherein the light projection unit is further configured to illuminate the film positioned on the work table.

3. The bag making and packaging machine according to claim 2, wherein the work table includes a flat portion that faces the front side of the film fed from the film roll, a slit that extends in the width direction of the film is formed in the flat portion, and the light projection unit is disposed below the flat portion and configured to project light through the slit.

4. The bag making and packaging machine according to claim 1, further comprising a terminal end detection component configured to detect that the film roll supported by the film roll support unit has reached a terminal end of the film roll, wherein the light projection unit blinks or lights up in response to detection by the terminal end detection component that the film roll has reached the terminal end of the film roll.

* * * * *